US007044811B2

(12) United States Patent
Chritz et al.

(10) Patent No.: US 7,044,811 B2
(45) Date of Patent: May 16, 2006

(54) PLUG CONTACT HAVING A CONTACT REGION BEING ACCESSIBLE FROM THREE SIDES

(75) Inventors: Gunther Chritz, Birkenau (DE); Gerhard Fischer, Wuerzburg (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/922,465

(22) Filed: Aug. 20, 2004

(65) Prior Publication Data

US 2005/0079747 A1 Apr. 14, 2005

(30) Foreign Application Priority Data

Aug. 22, 2003 (EP) ..... 03019029

(51) Int. Cl.
*H01R 11/22* (2006.01)
*H01R 13/11* (2006.01)

(52) U.S. Cl. ..... 439/856

(58) Field of Classification Search ..... 439/856, 439/863, 862, 816, 833, 682, 224, 660
See application file for complete search history.

(56) References Cited

U.S. PATENT DOCUMENTS

| | | | | |
|---|---|---|---|---|
| 4,037,917 | A * | 7/1977 | Clement | 439/831 |
| 4,041,358 | A | 8/1977 | Donahue et al. | |
| 4,553,799 | A * | 11/1985 | Deters | 439/507 |
| 4,934,967 | A | 6/1990 | Marks et al. | |
| 5,704,800 | A * | 1/1998 | Sato et al. | 439/342 |
| 6,089,905 | A * | 7/2000 | Shimmyo et al. | 439/495 |
| 6,551,143 | B1 | 4/2003 | Tanaka et al. | |

* cited by examiner

*Primary Examiner*—Chandrika Prasad
(74) *Attorney, Agent, or Firm*—Barley Snyder LLC

(57) ABSTRACT

A plug contact is provided which comprises a first pin connected to two contact plates arranged parallel to one another. The contact plates are also connected to two further pins which are arranged on a side of the contact plates opposed to the first pin. The three pins are arranged parallel to one another. The two contact plates are connected by connecting elements to the two further pins which are arranged in the region of the connection of the first pin and are guided via a 180° bend to the two further pins. The two contact plates comprise reciprocally associated notches between which a contact region is formed for contacting a contact pin. Owing to the selected geometry it is possible to introduce a contact pin from different directions into the contact region and retain the contact pin.

12 Claims, 2 Drawing Sheets

PLUG CONTACT HAVING A CONTACT REGION BEING ACCESSIBLE FROM THREE SIDES

FIELD OF THE INVENTION

This invention relates to a plug contact for a printed circuit board having a contact region defined between two plates and a geometry that allows for introducing a contact pin from different directions into the contact region and retaining the contact pin.

BACKGROUND OF THE INVENTION

A wide variety of plug contacts are known for use on printed circuit boards.

U.S. Pat. No. 4,934,967 discloses a plug contact for a printed circuit board for connecting a pin arrangement of an electronic circuit. The plug contact has an insulating housing in which openings for introducing a contact pin are provided. A spring contact is arranged in the openings which has two stacked pairs of contact plates. The contact plate pairs are arranged at a fixed spacing from one another. The two contact plates of a contact plate pair issue from a vertically arranged conductor strip and extend substantially vertically to the conductor strip in the form of an open ring. The open region of the ring is arranged opposite the conductor strip. The upper contact plates comprise a respective spring tongue oriented obliquely downwards in the direction of the conductor strip, on a lower side of the upper contact plates in an end region opposite the conductor strip.

U.S. Pat. No. 6,551,143 B2 a battery contact is known which comprises plug contacts. The plug contacts have a base plate on which two bent side faces are formed. The side faces are arranged substantially at an angle of 90° to the base plate. One respective contact arm is formed issuing from the two side faces. The contact arms are guided toward one another in the direction of the centre of the base plate and arranged above the base plate. The two contact arms have notches, which are each formed inwardly. The notches are arranged at the same level but have a fixed spacing from one another. A contact region is formed between the notches. The external contour of the notch is circular. The notches produce a reliable point contact with an inserted contact.

U.S. Pat. No. 4,041,358 a measuring instrument comprising a printed circuit board is known which has contact clips for electrically contacting a plug contact with the printed circuit board and which are substantially U-shaped in design. The ends of the contact clips are bent inwards and rest on one another. In addition, a further contact plate is provided which biases the legs of the contact clips on one another.

SUMMARY OF THE INVENTION

A plug contact is provided which comprises a first pin connected to two contact plates arranged parallel to one another. The contact plates are also connected to two further pins which are arranged on a side of the contact plates opposed to the first pin. The three pins are arranged parallel to one another. The two contact plates are connected by connecting elements to the two further pins which are arranged in the region of the connection of the first pin and are guided via a 180° bend to the two further pins. The two contact plates comprise reciprocally associated notches between which a contact region is formed for contacting a contact pin. Owing to the selected geometry it is possible to introduce a contact pin from different directions into the contact region and retain the contact pin.

BRIEF DESCRIPTION OF THE DRAWINGS

The invention will be described in more detail hereinafter with reference to the figures, in which.

DETAILED DESCRIPTION OF THE INVENTION

Figure 1:
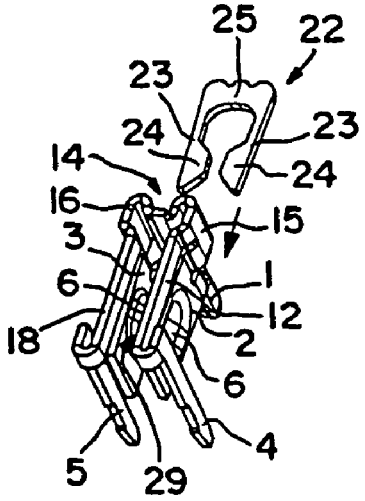
FIG. 1 is a perspective view of a plug contact with a holding clip according to an exemplary embodiment of the invention.

FIG. 1 shows a plug contact according to an exemplary embodiment of the invention. The plug contact substantially comprises a first pin 1 which is connected to a first and a second contact plates 2, 3. The first and the second contact plates 2, 3 are also connected to a third or to a fourth pin 4, 5. The first and the second contact plates 2, 3 each comprise a notch 6 which is preferably introduced in the form of a stamping operation into the contact plates 2, 3. The notches 6 are recessed inwardly so the notch 6 of the first contact plate 2 is impressed in the direction of the second contact plate 3 and the notch 6 of the second contact plate 3 in the direction of the first contact plate 2. A contact region 29 is formed between the notches 6. The notches 6 have a substantially oval shape which is arranged with the longitudinal side parallel to the longitudinal direction of the rectangular shape of the first or second contact plate 2. The contact plates are manufactured from a resilient material and are held resiliently between the first, the second and the third pin 1, 4, 5. The plug contact, in an exemplary embodiment, is advantageously manufactured in one piece from spring steel. The pins 1, 4, 5 of the plug contact are inserted into a printed circuit board 27. Depending on the application, a contact pin can be inserted from below through the printed circuit board or laterally between the contact plates. Two printed circuit boards, for example, may thus be electroconductively connected to one another.

In addition to the plug contact a holding clip 22 is illustrated which, in a preferred embodiment of the plug contact, is pushed onto the plug contact to bias the contact plates 2, 3.

Figure 2:
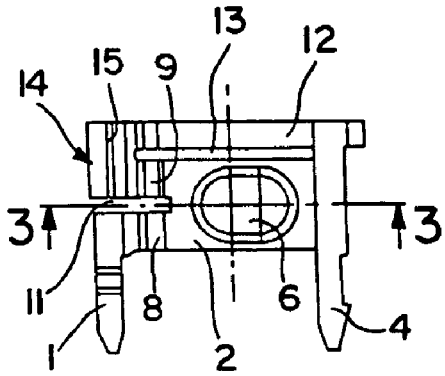
FIG. 2 is a side view of the plug contact of FIG. 1, with the holding clip omitted.

FIG. 2 shows a side view of the plug contact. The first pin 1 is connected by a first connecting piece 8 to the first contact plate 2. The first contact plate 2 has a substantially rectangular shape. The first connecting piece 8 is connected to a lower half of one side of the first contact plate 2. An upper half of the side is connected by a second connecting piece 9 to a middle piece 14. A gap 11 is formed between the first and the second connecting piece 8, 9. The gap 11 is arranged half way up the side of the first contact plate 2 and guided into an edge region of the first contact plate 2. The middle piece 14 is connected in an upper region to a first connecting strip 12. The first connecting strip 12 is guided to a leading region of the first contact plate 2. In the leading region the first connecting strip 12 is connected to the third pin 4 arranged substantially parallel to the first pin 1. In the illustrated embodiment the third pin 4 is arranged laterally on an outer side of the first contact plate 2. The third pin 4 thus serves in this embodiment as a stop for maximum bending of the first contact plate 2. The second and third pins 4, 5 may be alternatively arranged upstream of the first or second contact plate 2, 3, as a function of the selected embodiment, so that a stop is not provided for the first and the second contact plate 2, 3. The second contact plate 3 is constructed analogously to the first contact plate and connected by a fifth connecting piece 30 to the middle piece 14. The middle piece 14 is connected to a second connecting strip 18 guided above the second contact plate 3 into the leading region thereof. The second connecting strip 18 is connected to the third pin 5 arranged on the outer side adjacent to the second contact plate. The third pin 5 is used as a lateral stop for the second contact plate 3. The fifth connecting piece 30 (FIG. 4) is arranged mirror symmetrically to the first connecting piece 8.

The first and second connecting strips 12, 18 are guided parallel to the first or second contact plate 2 and spaced from the first contact plate 2 by a second gap 13.

Figure 3:
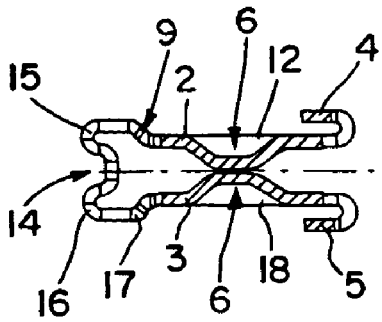
FIG. 3 is a cross-sectional view through the centre of the plug contact of FIG. 1, viewed from the bottom.

FIG. 3 shows a section 3—3 through the plug contact of FIG. 2. The middle piece 14 has, on both sides, first and second connecting tongues 15, 16 which are semicircular in cross-section and merge in a lower region into the second or fourth connecting piece 9, 17 and in an upper region into the first or second connecting strip 12, 18. The first and the second connecting tongues 15, 16 are, in a first region, in the process guided away from the first and second contact plate 2, 3 and subsequently oriented via a 180° bend in the direction of the first or the second contact plate 2, 3. The second connecting tongue 16 is connected by the fourth connecting piece 17 to the second contact plate 3.

The second connecting piece 9, the first connecting tongue 15, the middle piece 14 and the first connecting strip 12 provide a first connecting element via which the first contact plate 2 is resiliently held on the second pin 4.

The fourth connecting piece 17, the second connecting tongue 16, the middle piece 14 and the second connecting strip 18 provide a second connecting element via which the second contact plate 3 is resiliently held on the third pin 5.

The inner faces of the notches 6 of the two contact plates 2, 3 preferably have a small spacing, preferably less than 1 mm, or touch. In an upper region the middle piece 14 is connected to the second connecting tab 16 on the second connecting strip 18. The second connecting strip 18 is arranged mirror symmetrically to the first connecting strip 12 and connected to the second pin 5. The first and the second connecting strips 12, 18 are arranged substantially above the first or the second contact plate 2, 3. The end regions of the first and second connecting strip 12, 18 are guided beyond the end of the first or second contact plate 2, 3 and returned again upstream of the first or second contact plate via a 180° bend on the outer side of the first or second contact plate and connected in the leading region of the contact plates 2, 3 to the third and fourth pins 4, 5. The third and fourth pins 4, 5 are arranged laterally on outer sides of the first or second contact plate 2, 3 and provide a stop for maximum bending of the first or second contact plate 2, 3. The first and the second connecting tongues 15, 16 are connected in the upper region to the first or to the second connecting strip 12, 18 and in the lower region to the second or fourth connecting piece 9, 17.

Figure 4:
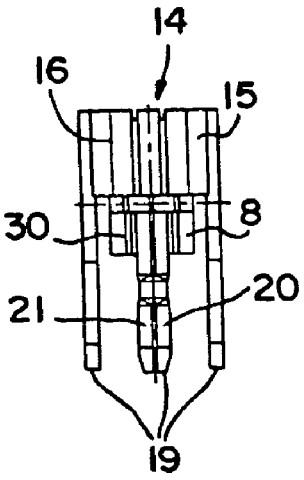
FIG. 4 is an end view of the plug contact of FIG. 1, showing a first pin.

FIG. 4 shows a view of the plug contact from the side of the first pin 1. The first, second and third pins 1, 4, 5 each have a plug end 19 arranged at the same height. The first pin 1 is formed from two pin parts 20, 21 folded parallel to one another in a folding operation.

Figure 5:
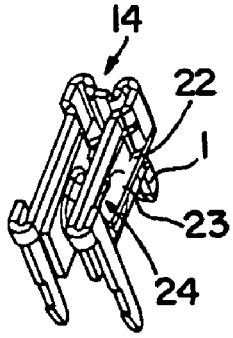
FIG. 5 is a plan view of the plug contact of FIG. 1 with a pushed-on holding clip.

FIG. 5 shows the plug contact of FIG. 1 with a pushed-on holding clip 22. The holding clip 22 has two holding hoops 23, each comprising a bulge 24 on the inner side in the end region. The bulges 24 are inserted into the notch 6 of the first and second contact plate 2, 3. The hoops 23 are connected to one another by a sixth connecting piece 25. The sixth connecting piece 25 is inserted into the gap 11.

Figure 6:
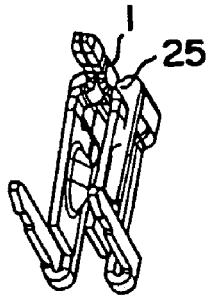
FIG. 6 shows the plug contact with pushed-on holding clip from below.

FIG. 6 shows the arrangement of FIG. 5 from below. The sixth connecting piece 25 is arranged above the first pin 1.

Figure 7:
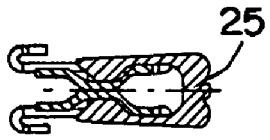
FIG. 7 shows a cross-section through the plug contact with inserted holding clip.

FIG. 7 shows a cross-section through the plug contact with the holding clip 22.

Figure 8:
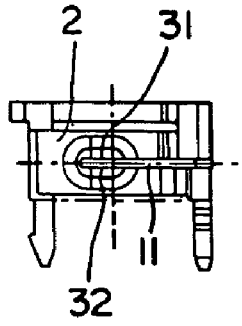
FIG. 8 shows a plug contact according to a further exemplary embodiment of the invention.

FIG. 8 shows a partial view of an inner side of the first contact plate 2 of a further embodiment of the plug contact, in which the gap 11 extends into the notches 6 of the first and second contact plate 2, 3. A first and a second contact edge 31, 32 adjoining the gap 11 are formed on the notch by the gap 11.

As a result of the extended construction of the gap 11, two contact edges 31, 32 extending parallel are formed on the inner side of the notches 6 which are mutually associated. The first and second contact edges 31, 32 increase the contactability, so the electric and thermal resistance is reduced on connection of a contact pin. The contact edges may be produced by an indent, a bead or other means.

Figure 9:
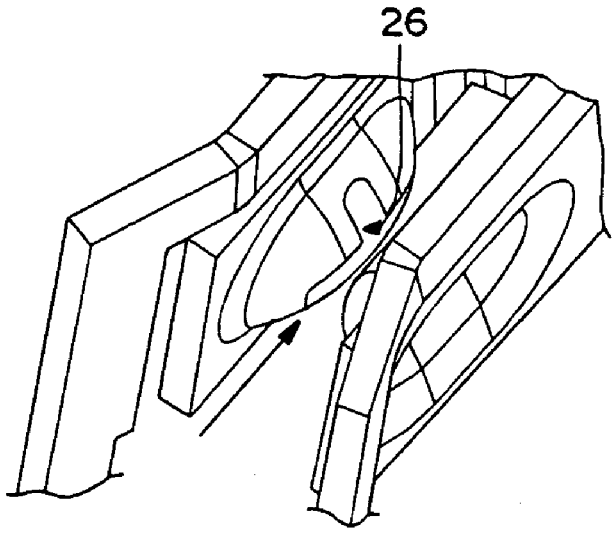
FIG. 9 shows a plug contact according to a further exemplary embodiment of the invention with notches of the holding clips which comprise a cruciform slot according to an exemplary embodiment of the invention.

FIG. 9 shows a detail of a further embodiment of the plug contact in which the notches 6 comprise a cruciform slot 26. A plurality of contact edges are thus formed on the inner sides of the notches 6. The electric and thermal contact is further improved thereby.

Figure 10:
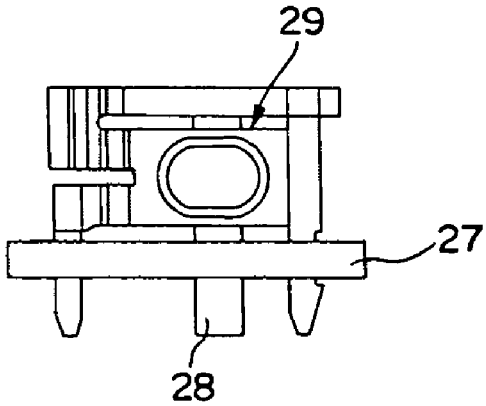
FIG. 10 is a side view of a plug contact with a printed circuit board and contact pin.

FIG. 10 shows a printed circuit board 27 with the plug contact and a contact pin 28 guided through the printed circuit board 27 and arranged in the contact region 29 of the plug contact and which is contacted with the plug contact via the clamping force of the contact plates.

Figure 11:
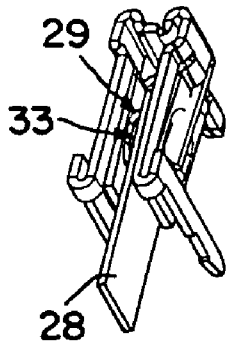
FIG. 11 is a perspective view of a plug contact with a laterally inserted contact pin according to an exemplary embodiment of the invention.

FIG. 11 shows a further contact situation in which the contact plug 28 is inserted from the front into the contact region 29 and fixed between the contact plates 2, 3.

The contact plug is, in an exemplary embodiment, produced from a metal plate in which a basic shape of the contact plug is punched out in a punching operation. The basic shape is then brought into the corresponding shape of the contact plug by a stamping and bending operation.

We claim:

1. A plug contact comprising:

a first pin adapted for retention on a printed circuit board; and two contact plates connected to the first pin, the contact plates being arranged side by side defining a contact region therebetween for receiving and contacting a contact pin, the two contact plates being arranged substantially perpendicularly to the first pin and defining a contact region for receiving the contact pin, wherein the contact region is accessible from three sides;

the first and the second contact plates being connected by a first or a further connecting piece to the first pin, and the first and the second contact plates being connected by a first or a second connecting element to a second third pin.

2. The plug contact according to claim 1, wherein each contact plate comprises a notch in the direction of the other contact plate, the notches being arranged opposing one another.

3. The plug contact according to claim 2, wherein an annular, peripheral contact region is formed between the contact plates adjacent to the notch.

4. The plug contact according to claim 1, wherein the first and the second connecting elements, starting from the first and the second contact plate, are formed to bend in a first region in the direction of the first pin, to bend in a second region in a direction away from the first pin, and to extend along the first or the second contact plate up to the second and third pins.

5. The plug contact according to claim 4, wherein the second and the third pins are arranged on the outer side of the first and second connecting elements adjacent to the first and the second contact plate.

6. The plug contact according to claim 4, wherein a gap is formed between the first pin and the connecting elements extending in the direction of the second and third pins, the gap being disposed at the level of the notches.

7. The plug contact according to claim 6, wherein the gap extends into the contact plates to the notches.

8. The plug contact according to claim 1, wherein the notches have contact edges formed by a gap therebetween.

9. The plug contact according to claim 4, wherein the connecting elements have a common middle piece connected on both sides by connecting tongues, which are semicircular in cross-section, in an upper section to third portions and in a lower section to first portions.

10. The plug contact according to claim 9, wherein the connecting tongues starting from the middle piece, are firstly directed away from the contact plates and returned via a bend in the direction of the contact plates.

11. The plug contact according to claim 1, further comprising a holding clip pushed onto the plug contact and biasing the contact plates against one another.

12. Plug contact according to claim 1, wherein the notches have a cruciform slot therein.

* * * * *

UNITED STATES PATENT AND TRADEMARK OFFICE

CERTIFICATE OF CORRECTION

PATENT NO. : 7,044,811 B2
APPLICATION NO. : 10/922465
DATED : May 16, 2006
INVENTOR(S) : Chritz et al.

It is certified that error appears in the above-identified patent and that said Letters Patent is hereby corrected as shown below:

In column 5, line 7, after "element to a second" insert --or a--

Signed and Sealed this

Seventh Day of November, 2006

JON W. DUDAS
*Director of the United States Patent and Trademark Office*